United States Patent [19]

Grabowski

[11] Patent Number: 4,713,868

[45] Date of Patent: Dec. 22, 1987

[54] INSTALLATION TOOL

[75] Inventor: Stanley E. Grabowski, Harrison, N.J.

[73] Assignees: Richard Drzyzga, Edison; Michael Drzyzga, Jr., Clifton, both of N.J. ; part interest to each

[21] Appl. No.: 862,032

[22] Filed: May 12, 1986

[51] Int. Cl.[4] ..... B25B 27/14

[52] U.S. Cl. ..... 29/275

[58] Field of Search ..... 29/275, 254, 255, 276, 29/277; 81/124.2

[56] References Cited

U.S. PATENT DOCUMENTS 1,914,257 6/1933 Holmes ..... 29/275

3,290,769 12/1966 Kashergen ..... 29/275

*Primary Examiner*—Robert C. Watson

*Attorney, Agent, or Firm*—Lerner, David, Littenberg, Krumholz & Mentlik

[57] ABSTRACT

An installation tool adapted for driving leader hooks into the side of a building for supporting a leader of a gutter system is disclosed. Conventionally, leader hooks are driven by means of a projecting shoulder using a hammer or other such compressive tool. The difficulty in installing these leader hooks has arisen as a result of the shoulder being relatively narrow and difficult to engage with blows of a compression tool. To this end, the installation tool is in the nature of a cap adapted to receive the head and shoulder of leader hooks having rectangular or circular-shaped heads. The installation tool, by being adapted to accommodate either shape, avoids the necessity of having to maintain a separate tool for each shape leader hook. In addition, the installation tool applies the compressive force directly to the shoulder by the provision of an abutment, thereby permitting efficient transfer of the compressive force thereto, while minimizing loss of such compressive force to the remaining portion of the leader hook.

20 Claims, 8 Drawing Figures

INSTALLATION TOOL

BACKGROUND OF THE INVENTION

The present invention relates in general to an installation tool, and more particularly, to an installation tool adapted for driving leader hooks of different shapes into the side of a building and the like for supporting a leader of a gutter system.

Known leader hooks are constructed to include a head having a shape designed to receive a leader and a spike for securing the leader hook into the side of a building. The spike is driven by means of a projecting shoulder extending outwardly from the spike using a hammer or other such compression tool. The difficulty in installing the known leader hooks has arisen as a result of the shoulder being relatively narrow and difficult to engage with blows of a compression tool. To this end, the present invention provides an installation tool in the nature of a cap having an enlarged anvil surface and adapted to receive the head and shoulder of a known leader hook. As leader hooks may be either of rectangular or circular shape, the installation tool is adapted to accommodate either shape, thereby avoiding the necessity of having to maintain a separate tool for each shape leader hook. In addition, as the compressive force is to be applied directly to the shoulder of the spike, the installation tool is provided with an abutment which permits efficient transfer of the compressive force thereto, while minimizing loss of the compressive force to the remaining portion of the leader hook.

An installation tool adapted for driving round-headed staples by application of a direct compressive force is known from U.S. Pat. No. 1,914,257. The staple installation tool is constructed of a handle supporting a head adapted to receive the rounded head of the staple and an anvil surface in general alignment with the spike of the staple. In driving the staple, a compressive force, for example, direct hammer blows, is applied to the anvil surface. However, the compressive force is applied not only to the staple's spike, but equally to its rounded head. This renders the staple installation tool unsuitable for use in driving leader hooks when installing leaders of generally thin walled construction, as found in gutter systems.

In this regard, the head of a leader hook is not constructed to withstand the compressive force necessary for driving the leader hook without causing its bending and permanent distortion. This bending of the leader hook head can result in the crushing of the thin walled leaders during installation, thereby necessitating their replacement. In addition, as the known staple installation tool is adapted solely to accommodate staples having a rounded head, such tool will not avoid the necessity of having to maintain a separate tool of a different shape, so as to accommodate leader hooks which may be either of rectangular or circular shape.

There is also known from U.S. Pat. Nos. 682,681, 981,278, 1,914,257, 2,089,907, 2,462,774, 2,642,105, 2,849,718, and 3,228,269 a variety of installation tools for driving miscellaneous objects, for example, nails, spikes, eye-screws and the like. These installation tools are likewise unsuitable for driving leader hooks into the side of a building for supporting a leader of a gutter system.

Accordingly, there is an unsolved need for an installation tool adapted to accommodate leader hooks of different shape and having an anvil surface adapted for applying direct compressive force to a shoulder on the leader hook, so as to minimize the application of such force to the hook's head.

SUMMARY OF THE INVENTION

In accordance with one aspect of the present invention, there is disclosed an installation tool for driving hooks having a rectangular or circular-shaped head and a shoulder extending therefrom for receiving striking forces. The installation tool is constructed of a body having an open mouth portion adapted to receive the rectangular and circular-shaped head of the hooks, and force applying means for applying a driving force to the shoulder sufficient for driving the hooks.

In accordance with another aspect of the present invention there is described an installation tool for driving hooks having a rectangular or circular-shaped head and a shoulder extending therefrom for receiving striking forces. The installation tool is constructed of a body having an open mouth formed from a profiled member, the profiled member having a profile adapted to accommodate a portion of the rectangular and circular-shaped head of the hooks, and an anvil having a striking surface and an abutment engaging the shoulder, the striking surface adapted for applying a driving force to the shoulder when in engagement with the abutment sufficient for driving the hooks.

BRIEF DESCRIPTION OF THE DRAWINGS

The above description, as well as further objects, features and advantages of the present invention, will be more fully understood by reference to the following detailed description of a presently preferred, but nonetheless illustrative, installation tool in accordance with the present invention, when taken in conjunction with the accompanying drawings, wherein.

DETAILED DESCRIPTION

Figure 1:
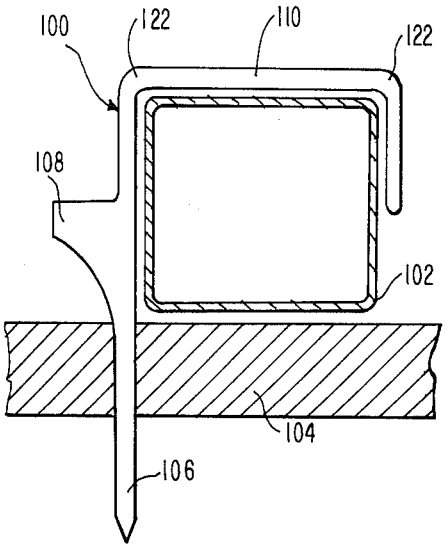
FIG. 1 PRIOR ART
FIG. 1 is a side elevational view, in partial cross-section, showing a rectangular-shaped leader hook adapted for securing a thin walled leader of corresponding rectangular shape to the side of a building.
Figure 2:
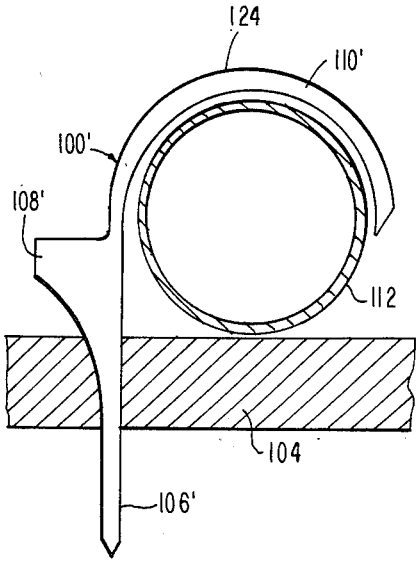
FIG. 2 PRIOR ART
FIG. 2 is a side elevational view, in partial cross-section, showing a circular-shaped leader hook adapted for securing a thin walled leader of corresponding circular shape to the side of a building.

Referring now to the drawings, wherein like reference numerals represent like elements, there is shown in FIG. 1 a leader hook 100 adapted for securing a thin walled, rectangular-shaped leader 102 to the side of a building 104 or the like. The leader hook 100 is constructed of a spike 106, a laterally extending shoulder 108 and a rectangular-shaped head 110. As shown in FIG. 2, the leader hook 100' has a circular-shaped head 110' and is adapted to accommodate a thin walled, circular-shaped leader 112. The leader hooks 100, 100' are of conventional metal construction for securing leaders 102, 112 of a gutter system to the side of the building 104 and are available from a number of commercial sources.

Figure 3:
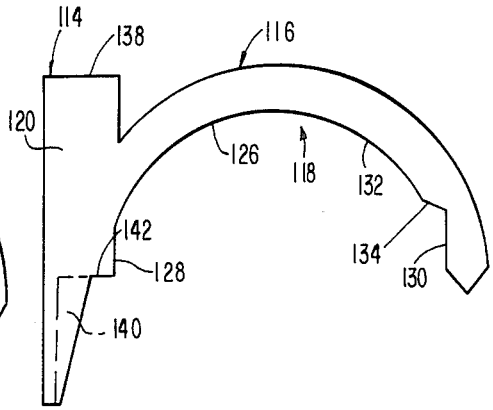
FIG. 3 is a side elevational view of a leader hook constructed in accordance with the present invention and adapted to accommodate leader hooks of rectangular and circular shape, as shwon in FIGS. 1 and 2.

Turning now to FIG. 3, there is shown an installation tool 114 constructed in accordance with one embodiment of the present invention. The tool 114 is constructed of a body 116 having an open mouth portion 118 and an anvil 120 integrally formed therewith. The open mouth portion 118 is adapted to receive the rectangular and circular-shaped heads 110, 110', while the anvil 120 is adapted for applying a driving force to the shoulders 108, 108' in an amount sufficient for driving the leader hooks into a secured position within a side of a building 104.

Figure 4:
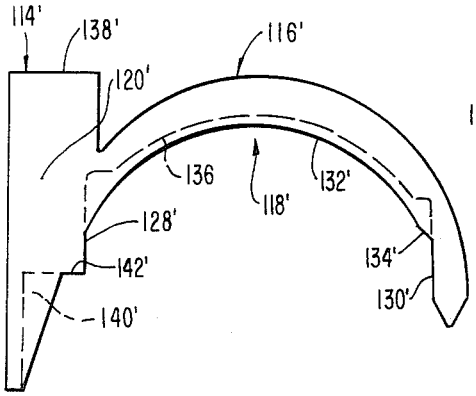
FIG. 4 is a side elevational view of a leader hook constructed in accordance with another embodiment of the present invention and adapted to accommodate leader hooks of rectangular and circular shape, as shown in FIGS. 1 and 2.

The body 116 is constructed as an arcuate-shaped, profiled member having a profile adapted to accommodate a portion of the rectangular and circular-shaped heads 110, 110'. Specifically, the profile of the body 116 is shaped to receive a pair of spaced-apart adjacent corners 122 of leader hook 100 and a circumferential segment 124 of head 110' of leader hook 100'. The profiled shape is formed from the inner surface 126 of the body 116 and includes a pair of parallel, spaced-apart surfaces 128, 130, an arcuate-shaped surface 132, and a chamfered surface 134. The surfaces 128, 130, 132, 134 provide the desired profile for accommodating the heads 110, 110' of the leader hooks 100, 100', as to be discussed hereinafter. In accordance with another embodiment of the present invention, there is shown in FIG. 4 an installation tool 114' whose profile is provided by a recess 136 extending within and along the arcuate-shaped surface 132' of the body 116'.

The anvil 120 is provided with an anvil striking surface 138 and an opposing formed recess 140 which provides an abutment 142 for engaging the shoulders 108, 108' of the leader hooks 100, 100'. To facilitate the application of a compressive force by, for example, direct hammer blows, the anvil striking surface 138 has an area which is substantially larger than the area along the upper edge of the shoulders 108, 108'. The installation tools 114, 114' can be made from a variety of rigid materials such as metal and the like.

Figure 6:
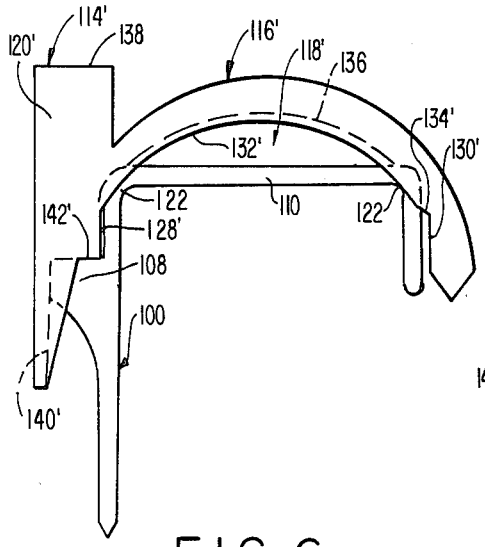
FIGS. 5–8 are side elevational views showing the driving of the leader hooks shown in FIGS. 1 and 2 by means of the installation tool shown in FIGS. 3 and 4.

Referring now to FIGS. 5–8, the use of the installation tools 114, 114' for driving leader hooks 100, 100' into the side of a building 104 for securing leaders 102, 112 of a gutter system will now be described. With specific reference to FIG. 5, a leader hook 100 having a rectangular-shaped head 110 is received within the open mouth 118 formed by the body 116 of the installation tool 114. The shoulder 108 of the leader hook 100 is received within the formed recess 140 of the anvil 120, so as to be engaged by the abutment 142 of the installation tool 114. The depending legs 144, 146 of the leader hook 100 are arranged adjacent the parallel surfaces 128, 130, with the chamfered surface 134 accommodating a corner 122 of head 110. When the installation tool 114' is employed, as shown in FIG. 6, the opposite corners 122 of the leader hook 100 are received within the recess 136 extending within and along the arcuate-shaped surface 132' of the body 116'. The recess 136 further functions to prevent accidental disengagement of the installation tool 114' from the leader hook 100 during the application of a compressive force to the anvil 120 during driving of the leader hook into the side of a building 104.

Figure 8:
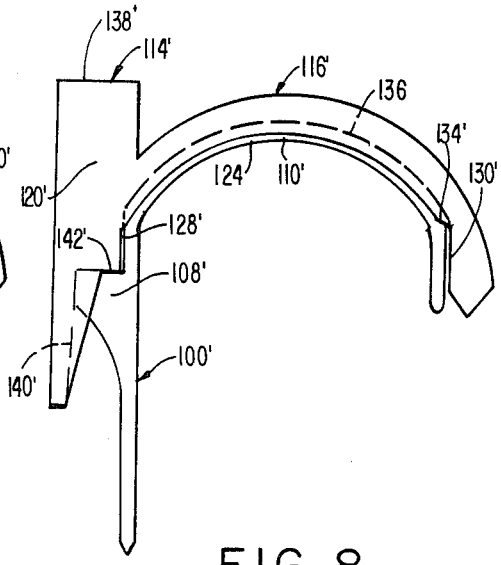
Figure 5:
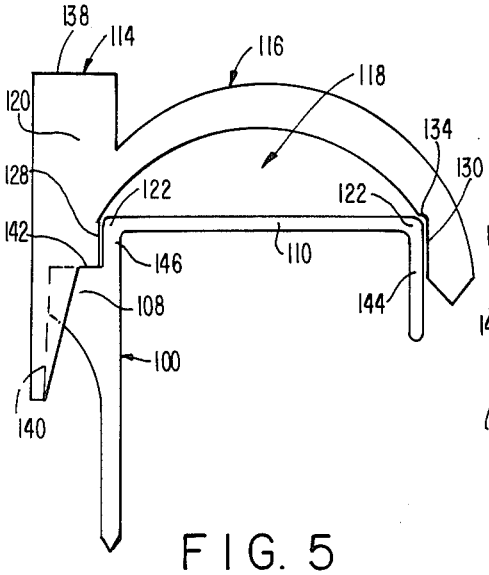
Figure 7:
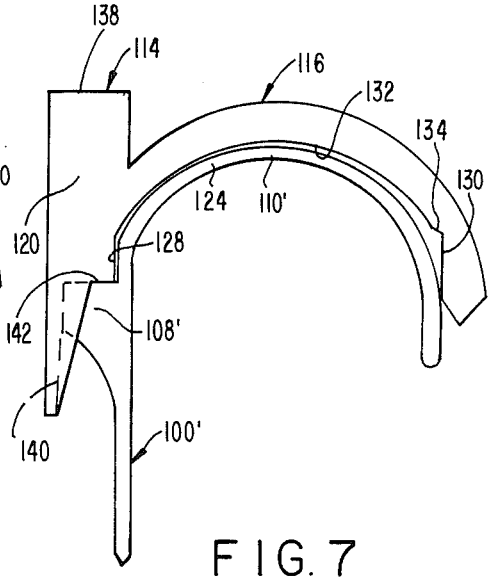

Turning now to FIGS. 7 and 8, the installation tools 114, 114' are illustrated in use for driving a leader hook 100' having a circular-shaped head 110'. When the installation tool 114, as shown in FIG. 7, is employed, the circular segment 124 of the head 110' of the leader hook 100' conforms to the provile of the arcuate-shaped surface 132 provided by the body 116. On the other hand, when the installation tool 114', as shown in FIG. 8 is employed, the circular segment 124 is received within the recess 136 provided within the body 116' to prevent accidental disengagement from the installation tool. The leader hook 100' is efficiently driven into the side of the building 104 by applying a compressive force to the anvil striking surface 138 or 138' using a compression tool such as a hammer or the like. As each blow of the hammer is applied to the anvil 120 or 120', the compressive force is transmitted directly to the underlying captured shoulder 108' of the leader hooks 100' by means of the abutment 142 or 142'. The anvil striking surface 138 or 138' being substantially larger than the upper edge of the shoulder 108', results in an effective and efficient transfer of the compressive force so as to drive the leader hook 100' with a minimum of effort.

Accordingly, there has thus far been described an installation tool constructed and arranged to accommodate leader hooks of different shapes and having an anvil striking surface adapted for applying direct compressive force to an extending shoulder on the leader hook in an effective and efficient manner, so as to minimize the application of such force to the head thereof. This is achieved by the installation tool being provided with an abutment which directly engages the shoulder of the leader hook. The ability of the installation tool to accommodate leader hooks of different shape, for example, rectangular or circular, avoids the necessity of having to maintain multiple installation tools to accommodate leader hooks of such different shapes.

Although the invention herein has been described with reference to particular embodiments, it is to be understood that these embodiments are merely illustrative of the principles and application of the present invention. It is therefore to be understood that numerous modifications may be made in the illustrative embodiments and that other arrangements may be made without departing from the spirit and scope of the present invention as defined by the appended claims.

What is claimed is:

1. An installation tool for driving hooks having a rectangular or circular-shaped head and a shoulder extending therefrom for receiving striking forces, said tool comprising a body having an open mouth portion constructed to receive the rectangular and circular-shaped head of said hooks, said open mouth portion including a first profiled portion for receiving a portion of said rectangular-shaped head and a second profiled portion for receiving a portion of said circular-shaped head, said first profiled portion being different from said second profiled portion, and force applying means for applying a driving force to said shoulder sufficient for driving said hooks.

2. The installation tool of claim 1, wherein said open mouth portion comprises a profiled member.

3. The installation tool of claim 2, wherein said profiled member includes said first profiled portion and said second profiled portion constructed to accommodate a portion of the rectangular and circular-shaped head of said hooks.

4. The installation tool of claim 3, wherein said first profiled portion is shaped to receive a portion of said rectangular-shaped head comprising a pair of spaced-apart adjacent corners thereof.

5. The installation tool of claim 4, wherein said second profiled portion is shaped to receive a portion of said circular-shaped head comprising a circumferential segment thereof.

6. The installation tool of claim 5, wherein said second profiled portion comprises a recess within a surface of said profiled member.

7. The installation tool of claim 1, wherein said force applying means comprises an anvil having an abutment engaging said shoulder and a striking surface for receiving said driving force for driving said hooks.

8. The installation tool of claim 7, wherein said abutment is formed from a recess within said anvil.

9. The installation tool of claim 7, wherein said abutment is in longitudinal alignment with said striking surface.

10. The installation tool of claim 7, wherein the area of said shoulder of said hooks is substantially smaller than the area of said striking surface.

11. An installation tool for driving hooks having a rectangular or circular-shaped head and a shoulder extending therefrom for receiving striking forces, said tool comprising a body having an open mouth formed from a profiled member, said profiled member having a profile adapted to accommodate a portion of the rectangular and circular-shaped head of said hooks, said profile shaped to receive a portion of said rectangular-shaped head comprising a pair of spaced-apart adjacent corners thereof and to receive a portion of said circular-shaped head comprising a circumferential segment thereof, and an anvil having a striking surface and an abutment engaging said shoulder, said striking surface adapted for applying a driving force to said shoulder when in engagement with said abutment sufficient for driving said hooks.

12. The installation tool of claim 11, wherein said profile comprises a recess within a surface of said profiled member.

13. The installation tool of claim 11, wherein said abutment is formed from a recess within said anvil.

14. The installation tool of claim 13, wherein said abutment is in longitudinal alignment with said striking surface.

15. The installation tool of claim 13, wherein the area of said shoulder of said hooks is substantially smaller than the area of said striking surface.

16. The installation tool of claim 11, wherein said profiled member is of arcuate shape.

17. The installation tool of claim 11, wherein the profile of said profile member is formed from a pair of spaced-apart, parallel surfaces, an arcuate-shaped surface and a chamfered surface.

18. The installation tool of claim 11, wherein said tool is adapted for driving leader hooks when installing leaders of a gutter system.

19. An installation tool for driving hooks having a rectangular or circular-shaped head and a shoulder extending therefrom for receiving striking forces, said tool comprising a body having an open mouth formed from a profiled member, said profiled member having a profile adapted to accommodate a portion of the rectangular and circular-shaped head of said hooks, said profile of said profile member formed from a pair of spaced-apart, parallel surfaces, an arcuate-shaped surface and a chamfered surface, and an anvil having a striking surface and an abutment engaging said shoulder, said striking surface adapted for applying a driving force to said shoulder when in engagement with said abutment sufficient for driving said hooks.

20. An installation tool for driving hooks having a rectangular or circular-shaped head and a shoulder extending therefrom for receiving striking forces, said tool comprising a body having an open mouth constructed from a profiled member having a profile adapted to accommodate a portion of the rectangular and circular-shaped head of said hooks, said profile shaped to receive a portion of said rectangular-shaped head comprising a pair of spaced-apart adjacent corners thereof and to receive a portion of said circular-shaped head comprising a circumferential segment thereof, and force applying means for applying a driving force to said shoulder sufficient for driving said hooks.

* * * * *